United States Patent [19]

Cave et al.

[11] 4,403,453

[45] Sep. 13, 1983

[54] STYLUS CONING FIXTURE

[75] Inventors: Eric F. Cave; James J. Cowden, both of Indianapolis, Ind.

[73] Assignee: RCA Corporation, New York, N.Y.

[21] Appl. No.: 313,577

[22] Filed: Oct. 21, 1981

[51] Int. Cl.[3] ..... B24B 5/14

[52] U.S. Cl. ..... 51/124 R; 51/131.1; 51/237 R; 51/283 R

[58] Field of Search ..... 51/237 R, 121, 124 R, 51/131.1, 283 R

[56] References Cited

U.S. PATENT DOCUMENTS

| | | | |
|---|---|---|---|
| 2,454,472 | 11/1948 | Monkley | 51/124 R |
| 3,020,680 | 2/1962 | Soderman | 51/124 R |
| 3,190,044 | 6/1965 | Villalobos | 51/124 R |
| 3,902,283 | 9/1975 | Bean | 51/125.5 |
| 4,106,240 | 8/1978 | DeBartolo | 51/125 |
| 4,254,587 | 3/1981 | Wilson | 51/124 R |

*Primary Examiner*—Harold D. Whitehead

*Attorney, Agent, or Firm*—Birgit E. Morris; Donald S. Cohen; Thomas H. Magee

[57] ABSTRACT

An apparatus for positioning the tip of a stylus adjacent a rotating scaife while continuously rotating the stylus comprises a base plate connected to a platform by means for sweeping the plate through a sweep arc. A tube is connected to the base plate by means for pivoting the tube about an axis parallel to the surface of the scaife, and is also connected to means for exerting a constant torque about the axis in a direction forcing one end of the tube toward the surface of the scaife. The tube supports a rotating shaft and is positioned to allow one end of the shaft to move adjacent the surface of the scaife, the one end of the shaft being adapted to hold the shank of a stylus. A ramp block is mounted on the platform between the base plate and the scaife. The block has an inclined ramp oriented along a direction which allows the tube to make contact therewith, while the stylus is positioned adjacent the surface of the scaife, and be lifted from the surface of the scaife when the sweeping means moves the plate through a portion of the sweep arc.

12 Claims, 4 Drawing Figures

STYLUS CONING FIXTURE

This invention relates to an apparatus and method for positioning the tip of a stylus adjacent a rotating scaife while continuously rotating the stylus.

BACKGROUND OF THE INVENTION

Information playback systems frequently utilize a stylus for reading signals from the surface of an information record, typically a plastic disc that contains stored video and audio information. In some systems the information record has a fine spiral groove to guide the tip of a stylus that contains a thin electrode. In these systems, the stylus tip is made of a material having sufficient hardness to withstand the abrasion caused from tracking the groove. Materials which possess such hardness, such as diamond, generally have a crystallographic structure which presents surfaces exhibiting different qualities depending upon which crystallographic plane the surfaces are oriented along. The video disc stylus utilized in the CED (capacitance electronic disc) system is tapered to form the prow of the tip, and is also lapped to form a keel having a V-shaped shoe for its bottom portion. This keel-shaped tip has a shoe length of about 3 to 5 micrometers and a thickness of about 2 micrometers. Making a long-shanked stylus entirely from the same material may become expensive, particularly when the tip material, for example diamond, exceeds the cost of other suitable materials from which the shank can be made.

In order to reduce manufacturing costs, the shank of the stylus may be made from a different material which is less expensive than the crystallographic tip material. For example, a small diamond stone may be mounted at the end of a relatively long metallic shank, such as a cylindrical titanium rod. The diamond stone utilized may be a synthetic diamond stone which is less expensive to obtain than a natural diamond stone. The synthetic diamond stone has a plurality of facets oriented along the {100} family of planes and a plurality of facets oriented along the {111} family of planes. The diamond stone is typically mounted in a concave-shaped cavity at the end of the metallic shank by any means capable of holding the stone therein, such as utilizing a braze, setting the stone in a pocket of adhesive epoxy or the like.

In fabricating the keel-shaped tip from the shank-mounted diamond stone, the end at which the stone is mounted is first coned, in order to form a conical diamond tip and also remove a portion of the surrounding shank metal, so that it will not interfere with subsequent stylus processing. A novel method for performing this coning is described in a commonly-owned patent application of E. F. Cave and J. J. Cowden entitled "STYLUS MANUFACTURING METHOD", RCA Docket No. 76,657, filed on Oct. 13, 1981, and having Ser. No 310,857. This coning method produces a prismatic cone which exhibits fourfold symmetry due to the anisotropic hardness of the diamond crystalline structure. The cone actually becomes a tetrahedron with slightly-rounded sides due to compliance with system parameters. A major advantage of this method is that the crystallographic directions are automatically revealed, thereby providing an alignment means for orienting the stylus during subsequent processing. In order to properly perform the novel coning method, it is necessary that the lapping operation be carried out under critical system specifications, including the application of a substantially constant force of predetermined magnitude between the stylus and rotating scaife. In order to accomplish such a lapping operation, the present invention provides a novel stylus coning apparatus for positioning and holding the tip of a stylus adjacent a rotating scaife while continuously rotating the stylus.

SUMMARY OF THE INVENTION

The present invention comprises an apparatus and method for positioning the tip of a stylus adjacent a rotating scaife while continuously rotating the stylus. The apparatus includes a base plate connected to a platform by means for sweeping the plate through a sweep arc. A tube is connected to the base plate by means for pivoting the tube about an axis parallel to the surface of the scaife, and is also connected to means for exerting a constant torque about the axis in a direction forcing one end of the tube toward the surface of the scaife. The tube supports a rotating shaft and is positioned to allow one end of the shaft to move adjacent the surface of the scaife, the one end of the shaft adapted to hold the shank of a stylus. A ramp block is mounted on the platform between the base plate and the scaife. The block has an inclined ramp oriented along a direction which allows the tube to make contact therewith, while the stylus is positioned adjacent the surface of the scaife, and be lifted from the surface of the scaife when the sweeping means moves the plate through a portion of the sweep arc.

DETAILED DESCRIPTION OF THE PREFERRED EMBODIMENT

Figures 1, 4:
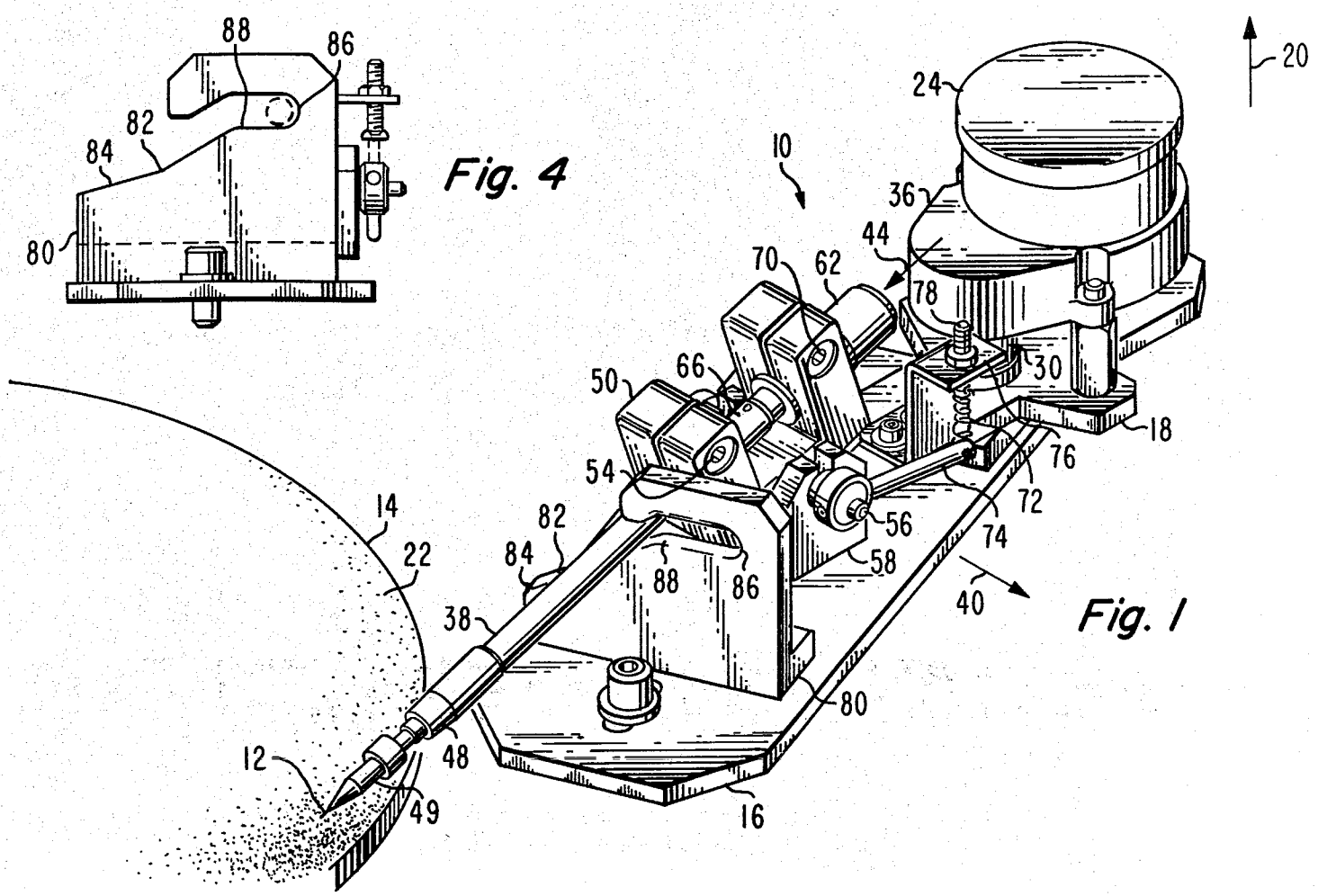
FIG. 1 is a perspective view of the present novel apparatus with stylus positioned adjacent a rotating scaife.
FIG. 4 is a front-end elevation view of the apparatus shown in FIG. 2.

In FIG. 1 of the drawing, there is shown one embodiment of an apparatus 10 for positioning and holding the tip of a stylus 12 adjacent a rotating scaife 14 while continuously rotating the stylus 12. The apparatus 10 comprises a platform 16 adapted to be mounted adjacent the scaife 14. A base plate 18 is connected to the platform 16 by means for sweeping the base plate 18 through a sweep arc about a first axis 20 orthogonal to the surface 22 of the scaife 14.

Figure 2:
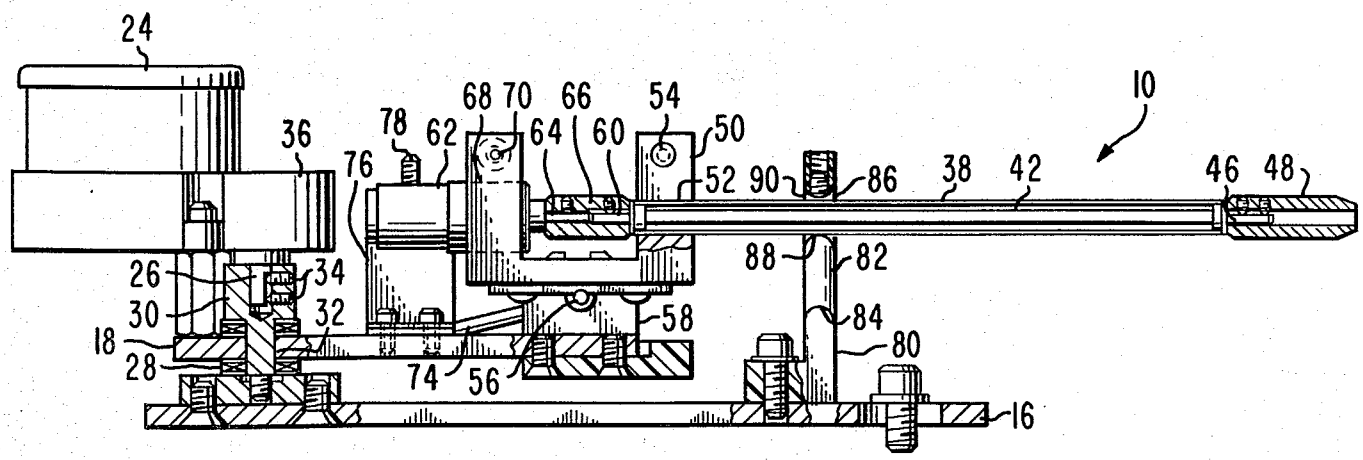
FIG. 2 is an elevation view of the novel apparatus shown in FIG. 1, but in a different position without the stylus, with portions thereof shown in cross-section.
Figure 3:
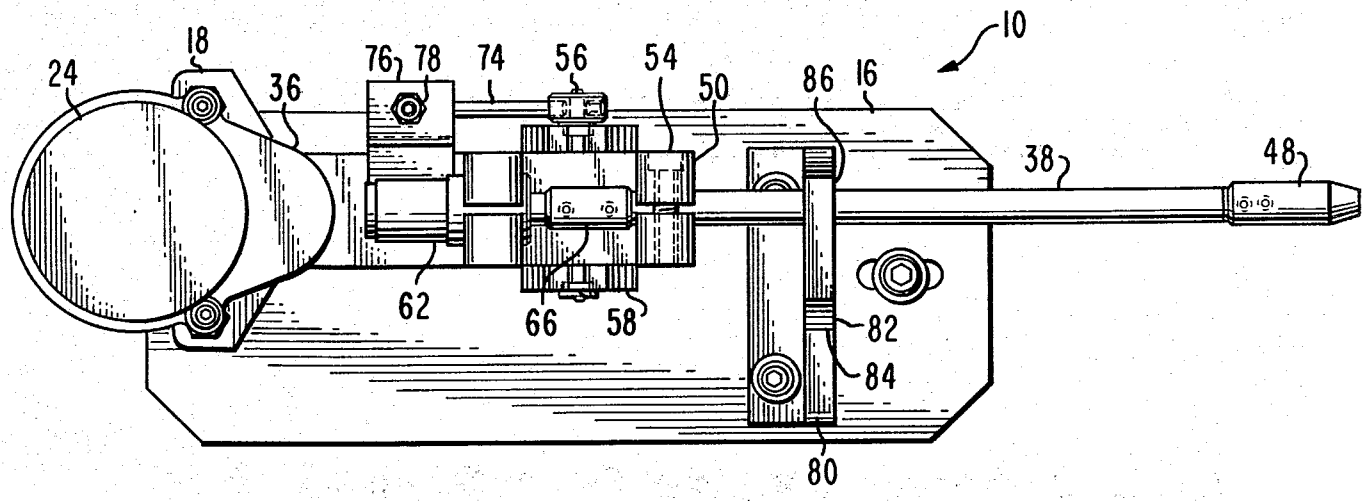
FIG. 3 is a plan view of the apparatus shown in FIG. 2.

In the present embodiment, the sweeping means comprises a stepper motor 24 which has the housing thereof mounted on the base plate 18. The driveshaft 26 of the stepper motor 24 is connected to the platform 16, as shown in FIG. 2. Preferably, the base plate 18 is rotatably supported by a roller bearing 28 surrounding a spindle 30 affixed to the platform 16 and passing through a bearing-lined aperture 32 in the plate 18. The spindle 30 is then connected to the driveshaft 26 of the stepper motor 24 by means of a pair of socket screws 34, as illustrated in FIG. 2. In the present embodiment, the driveshaft 26 of the stepper motor 24 is actually connected to a reduction gear box 36 for effecting a 30:1 gear reduction prior to being connected to the spindle 30. Such a stepper motor 24 is available from Hurst Manufacturing Company, Princeton, Indiana.

The novel apparatus 10 further comprises a tube 38 connected to the base plate 18 by means for pivoting the tube 38 about a second axis 40 orthogonal to the first axis 20. The tube 38 rotatably supports a shaft 42 adapted to rotate about a third axis 44 oriented along the longitudinal axis of the tube 38. One end 46 of the shaft 42 is adapted to hold the shank of the stylus 12. In the present embodiment, the one end 46 is connected to an adaptor 48 which has a collet 49 into which the shaft of the stylus 12 may be press-fitted.

The means for pivoting the tube 38 comprises a clamping bracket 50 for holding the tube 38. The tube 38 is positioned in the clamping bracket 50 so as to allow one end 46 of the shaft 42 to move adjacent the surface 22 of the scaife 14. The tube 38 is actually inserted through a first circular aperture 52 having a split therein, which can be drawn together around the tube 38 to securely hold the tube 38 by tightening a first clamping screw 54 which decreases the diameter of the first aperture 52 by narrowing the width of the split. The clamping bracket 50 has an axle 56 attached thereto and is rotatably supported by the sides of a clevis bracket 58 affixed to the base plate 18. In the present embodiment, the axle 56 is actually brazed to the underside of the clamping bracket 50, so that it becomes one integral piece which is able to precisely transmit a torque about the second axis 40, as explained further below.

The clamping bracket 50 also holds means connected to the other end 60 of the shaft 42, for rotating the shaft 42 about the third axis 44. In the present embodiment, the rotating means comprises a dc motor 62 held by the clamping bracket 50 in a position adjacent the shaft 42, as shown in FIG. 2. The dc motor 62 is positioned so that the driveshaft 64 thereof is connected to the other end 60 of the shaft 42 by a coupling 66. The dc motor 62 is actually inserted through a second circular aperture 68 in the clamping bracket 50. This second aperture 68 has a split therein, which can be drawn together around a portion of the dc motor 62 to firmly hold the motor 62 by tightening a second clamping screw 70 which decreases the diameter of the second aperture 68 by narrowing the width of the split. Preferably, the dc motor 62 rotates the shaft 42 at about sixty (60) revolutions per minute (rpm). Such a motor 62 is available as a dc micro motor from Portescap U.S., West Caldwell, New Jersey.

The apparatus 10 further comprises means supported by the base plate 18 and connected to the pivoting means for exerting a constant torque about the second axis 40 in a direction forcing the one end 46 of the shaft 42 toward the surface 22 of the scaife 14. In the present embodiment, the exerting means comprises an extension spring 72 having one end thereof connected to one end of a lever 74 affixed to the axle 56, and the other end thereof supported by an overhang bracket 76 mounted on the base plate 18. Preferably, the overhang bracket 76 is "L-shaped" at both ends, as illustrated in FIG. 1, and has an adjustable screw 78 at the end holding the spring 72, in order to adjust the tension on the spring 72 by rotating the screw 78. The spring 72 is designed so that it may provide to the lever 74 a substantially constant unit force of 30 to 40 grams weight, which is equal to $3.5\times10^4$ dynes absolute force. The other end of the lever 74 is connected to the axle, in order to transmit a torque about the second axis 40. It is important that an exact torque be transmitted about the second axis 40, so that the force applied between the tip of the stylus 12 and the abrasive surface 22 remains substantially constant. If this force is too small, an extremely long time is required for the coning operation; if the force is too great, the tip becomes too hot, causing the braze to fail and the diamond stone to either loosen or fall out.

The apparatus 10 also comprises a ramp block 80 mounted on the platform 16 between the base plate 18 and the scaife 14. The ramp block 80 has an inclined ramp 82 oriented along a direction sufficiently orthogonal to the third axis 44 to allow the tube 38 to make contact therewith, while the stylus 12 is positioned adjacent the surface 22 of the scaife 14, and be lifted from the surface 22 of the scaife 14 when the sweeping means moves the base plate 18 through a portion of the sweep arc. In the present embodiment, the inclination, or slope, of the inclined ramp 82 is less at the lower portion 84, as shown in FIG. 4. Preferably, the ramp block 80 has a physical stop 86 disposed at the top portion 88 of the inclined ramp 82, in order to receive the tube 38 at a rest, or non-lapping, position. The physical stop 86 may include a depressable ball plunger 90 for holding the tube 38 at this rest position.

The present method of positioning the tip of the stylus 12 adjacent the rotating scaife comprises the first step of mounting the stylus 12 at the one end 46 of the shaft 42. In the present embodiment, the operation of the stepper motor 24 and the dc motor 62 is controlled by a preprogrammed microprocessor (not shown) which runs the apparatus 10 through a lapping sequence in response to a start signal initiated by an operator.

Upon actuation of the start signal, the dc motor 62 is engaged so that the driveshaft 64 is rotated about the third axis 44, preferably, at approximately sixty (60) revolutions per minute (rpm). The scaife 14 is also rotated, illustratively, at between 2,000 and 3,000 revolutions per minute.

The base plate 18 is then swept through a sweep arc about the first axis 20 from a first position, whereat the tube 38 is supported at the top of the ramp block 80 at the rest position, to a second position, whereat the tip of the stylus 12 is positioned adjacent the surface 22 of the scaife 14. In the present embodiment, the micropressor feeds a series of electrical pulses to the stepper motor 24, which turns the driveshaft 26 and thereby causes the base plate 18 to turn. Each pulse rotates the driveshaft 26 seven and one half (7.5) degrees which, due to the effect of the 30:1 gear reduction, sweeps the base plate 18 through about seventeen (17) degrees of the sweep arc. In the present example, sixty-five (65) pulses are utilized to sweep the base plate 18 from the first position to the second position, which causes the tube 38 to move from the rest position at the top portion 88 of the ramp block 80, down the steeper-sloped portion of the inclined ramp 82, and down the shallow-sloped portion of the ramp 82 until the tip of the stylus 12 contacts the rotating surface 22. The purpose of the shallower-sloped portion of the inclined ramp 82 is to allow a soft setdown of the stylus 12 as it contacts the rotating surface 22. The soft setdown is critical in order not to cause any undesirable damage to the tip of the stylus 12 which might occur with a harder setdown. At the setdown position, the angle between scaife 14 and the shaft 42 is, preferably, about fifteen (15) degrees.

After making contact with the scaife's surface 22, the base plate 18 continues to sweep until the tip of the stylus 12 is swept across a portion of the rotating surface 22 to an inner radius. The polarity of the pulses to the stepper motor 24 is then reversed, and thirty-five (35) pulses are utilized to sweep the base plate 18 back in the opposite direction. This causes the tube 38 to move back through about nine (9) degrees of the sweep arc, which is not enough to permit the tube 38 to contact the ramp 82. The polarity reversals are continued at thirty-five (35) pulse intervals in order to sweep the tip of the stylus 12 back and forth across the scaife's surface 22 through the nine (9) degree sweep arc. In the present example, a thirty-five pulse interval causes the tube 38 to sweep back and fourth at about fifty (50) oscillations per minute. After sweeping for about thirty (30) seconds, another sixty-five (65) pulse signal causes the tube 38 to move adjacent the ramp block 80, up the inclined ramp 82, and back to the rest position.

The essence of the present invention is the cooperative combination of the extension spring 72 with the inclined ramp 82, in order to achieve not only a soft, damage-free setdown of the stylus 12 adjacent the rotating scaife 14, but also to effectively lap the tip of the stylus 12. The extension spring 72 is critical in that it provides a substantially constant force between the stylus 12 and the rotating scaife 14. The extension spring 82 also holds the tube 38 adjacent the inclined ramp 82. The ramp 82 not only provides for a soft setdown but also returns the stylus 12 to a rest position, whereat an operator can easily replace the lapped stylus 12. The present novel apparatus 10 is able to operate as described above while continuously rotating the shaft 42, thereby enabling the novel coning method to produce a prismatic cone in compliance with system parameters.

What is claimed is:

1. An apparatus for positioning the tip of a stylus adjacent a rotating scaife while continuously rotating said stylus comprising:

a platform adapted to be mounted adjacent said scaife, a base plate connected to said platform by means for sweeping said plate through a sweep arc about a first axis orthogonal to the surface of said scaife, a tube connected to said base plate by means for pivoting the tube about a second axis orthogonal to said first axis, said tube rotatably supporting a shaft adapted to rotate about a third axis oriented along the longitudinal axis of said tube, and positioned to allow one end of said shaft to move adjacent the surface of said scaife, said one end adapted to hold the shank of said stylus, means mounted on said pivoting means and connected to the other end of said shaft for rotating said shaft about said third axis, means supported by said base plate and connected to said pivoting means for exerting a constant torque about said second axis in a direction forcing the one end of said shaft toward the surface of said scaife, and a ramp block mounted on said platform between said base plate and said scaife, said block having an inclined ramp oriented along a direction sufficiently orthogonal to said third axis to allow said tube to make contact therewith, while said stylus is positioned adjacent the surface of said scaife, and be lifted from the surface of said scaife when said sweeping means moves said plate through a portion of said sweep arc.

2. An apparatus as defined in claim 1 wherein said sweeping means comprises a stepper motor having the housing thereof mounted on said base plate and having the driveshaft thereof connected to said platform.

3. An apparatus as defined in claim 2 wherein said base plate is rotatably supported by a roller bearing surrounding a spindle affixed to said platform and passing through a bearing-lined aperture in said plate, said spindle being connected to the driveshaft of said stepper motor.

4. An apparatus as defined in claim 3 wherein the driveshaft of said stepper motor is connected to a reduction gear box for effecting a gear reduction prior to being connected to said spindle.

5. An apparatus as defined in claim 1 wherein said pivoting means comprises a clamping bracket holding said tube, said clamping bracket having an axle attached thereto and rotatably supported by the sides of a clevis bracket affixed to said base plate.

6. An apparatus as defined in claim 5 wherein said rotating means comprises a dc motor held by said clamping bracket in a position adjacent said shaft, the driveshaft of said dc motor being connected to the other end of said shaft by a coupling.

7. An apparatus as defined in claim 5 wherein said exerting means comprises an extension spring having one end thereof connected to a lever affixed to said axle and the other end thereof supported by an overhang bracket mounted on said base plate.

8. An apparatus as defined in claim 1 wherein said ramp block has a physical stop disposed at the top portion of said inclined ramp, and wherein the inclination, or slope, of said ramp is less at the lower portion thereof.

9. A method of positioning the tip of a stylus adjacent a rotating scaife while continuously rotating said stylus comprising the steps of:

mounting said stylus at one end of a shaft for rotation about a first axis oriented along the longitudinal axis of a tube rotatably supporting said shaft, pivoting the tube about a second axis parallel to the surface of said scaife so as to allow the one end of said shaft to move adjacent the surface of said scaife, rotating said shaft about said first axis, and sweeping a base plate through a sweep arc across the surface of a ramp block about a third axis orthogonal to the surface of said scaife, from a first position, whereat said tube is supported at the top of said ramp block mounted on a platform between said base plate and said scaife, said block having an inclined ramp oriented along a direction sufficiently orthogonal to said first axis to allow said tube to be lowered to the surface of said scaife, to a second position, whereat the tip of said stylus 12 is positioned adjacent the surface of said scaife, holding said tube adjacent said ramp by exerting a constant torque about said second axis in a direction forcing the one end of said shaft toward the surface of said scaife.

10. A method as recited in claim 9 wherein said rotating step is performed by a dc motor mounted on said pivoting means and connected to the other end of said shaft.

11. A method as recited in claim 9 wherein said sweeping step is performed by a stepper motor having the housing thereof mounted on said base plate and having the driveshaft thereof connected to said platform.

12. A method as recited in claim 11 comprising rotably supporting said base plate by a spindle affixed to said platform and passing through a bearing-lined aperture in said plate, said spindle being affixed to the driveshaft of said stepper motor.

* * * * *